United States Patent [19]

Gray

[11] 4,162,887

[45] Jul. 31, 1979

[54] OIL BURNER

[75] Inventor: David Gray, Bournemouth, England

[73] Assignee: Greenmace Limited, London, England

[21] Appl. No.: 799,327

[22] Filed: May 23, 1977

[51] Int. Cl.[2] ..... F23N 5/00

[52] U.S. Cl. ..... 431/28; 126/351; 431/11; 431/74

[58] Field of Search ..... 431/28, 41, 72, 7 H, 431/11; 126/35 DR, 351, 110 AA

[56] References Cited

U.S. PATENT DOCUMENTS

| | | | |
|---|---|---|---|
| 2,319,711 | 5/1943 | Van Almelo | 431/28 |
| 2,397,986 | 4/1946 | Senninger | 431/28 X |
| 2,552,302 | 5/1951 | Young | 431/41 X |
| 2,582,827 | 1/1952 | Gibson | 431/28 |
| 2,967,923 | 1/1961 | Reilly | 431/41 |
| 3,794,014 | 2/1974 | McVickar | 126/110 AA |

FOREIGN PATENT DOCUMENTS

| | | | |
|---|---|---|---|
| 751635 | 7/1956 | United Kingdom | 431/28 |
| 1026969 | 4/1966 | United Kingdom | 431/89 |

*Primary Examiner*—Edward G. Favors
*Attorney, Agent, or Firm*—Oblon, Fisher, Spivak, McClelland & Maier

[57] ABSTRACT

An oil burner comprising an oil/air jet nozzle has a central oil orifice and an outer air orifice; a chamber for oil connected through a control valve to the central orifice; means for supplying air under pressure through a pressure responsive switch and a control valve to the outer orifice, for atomizing oil from the central orifice; means for supplying combustion air through a conduit around the nozzle; an electrically operated ignition means adjacent the nozzle; means for detecting the absence of ignition; and control means operated by the detecting means and the pressure responsive switch for closing the valves on absence of air under pressure, for actuating the ignition means on the detection of the absence of ignition, and for closing the valves on failure of the ignition means to ignite the oil/gas mixture from the nozzle. The invention includes a space heater comprising a hollow canister having an outer wall and a spaced inner wall defining therebetween an inter-wall passage, and means for blowing space heating air into the passage. In that case, the oil burner is arranged with a conduit bridging the inter-wall passage, whereby the flame of the oil burner is directed into the interior of the inner wall and heats that inner wall and hence the air passing through the passage. The oil burner may also be used in a water heater.

4 Claims, 4 Drawing Figures

14
2
18
16
10
54
42
52
8
12
6
4
38
20
40
26
32
36
50
48
46
44
A
60
28
30
34
62
64
24
23
58
56

OIL BURNER

BACKGROUND OF THE INVENTION

1. Field of the Invention

This invention relates to an oil burner for use in heating liquids and gases, for example. Thus the burner may be employed in a space heater in which a current of air is heated indirectly by the oil burner, or in a water heater in which water is heated by the burner through a heat exchanger.

2. Description of the Prior Art

Garage workshops have in the past purchased large quantities of kerosene for use with heaters of the type described and yet at the same time have had to pay contractors to dispose of similarly large quantities of waste, dirty, sump oil which accumulates following servicing operations on vehicles involving oil changes.

SUMMARY OF THE INVENTION

An object of the invention is to provide a space heater of the type described wherein it is possible to utilize waste, dirty, sump oil as fuel.

The present invention resides in an oil burner comprising an oil/air jet nozzle having a central oil orifice and an outer orifice; oridice; a chamber for oil; means for preheating oil in the chamber; means for connecting the oil chamber through a control valve to the central orifice; means for supplying air under pressure through a pressure responsive switch and a control valve to the outer orifice, for atomizing oil from the central orifice; means for supplying combustion air through a conduit around the nozzle; an electrically operated ignition means adjacent the nozzle; means for detecting the absence of ignition; and control means operated by the detecting means and the pressure responsive switch for closing the valves on absence of air under pressure, for actuating the ignition means on the detection of the absence of ignition, and for closing the valves on failure of the ignition means to ignite the oil/gas mixture from the nozzle. Such an oil burner is capable of burning dirty oil, such as waste sump oil from internal combustion engines.

The invention includes a space heater comprising a hollow canister having an outer wall and a spaced inner wall defining there between an inter-wall passage, and means for blowing space heating air into the passage. In that case, the oil burner as defined above is arranged with a conduit bridging the inter-wall passage, whereby the flame of the oil burner is directed into the interior of the inner wall and heats that inner wall and hence the air passing through the passage.

The oil burner may also be used in a water heater. The water heater then comprises a water chamber, a combustion chamber separated from but contiguous with the water chamber; heat exchanger tubes communicating with the combustion chamber and passing through the water chamber, and the oil burner as defined above is arranged with its nozzle directed into the combustion chamber so that the hot combustion gases pass through the tubes and heat the water in the water chamber.

BRIEF DESCRIPTION OF THE DRAWINGS

Other objects and many of the attendant advantages of the present invention will be readily appreciated as the same becomes better understood by reference to the following detailed description when considered in connection with the accompanying drawings, in which like reference characters designate the same or similar parts throughout the figures thereof and wherein.

DETAILED DESCRIPTION OF THE PREFERRED EMBODIMENTS

Figure 1:
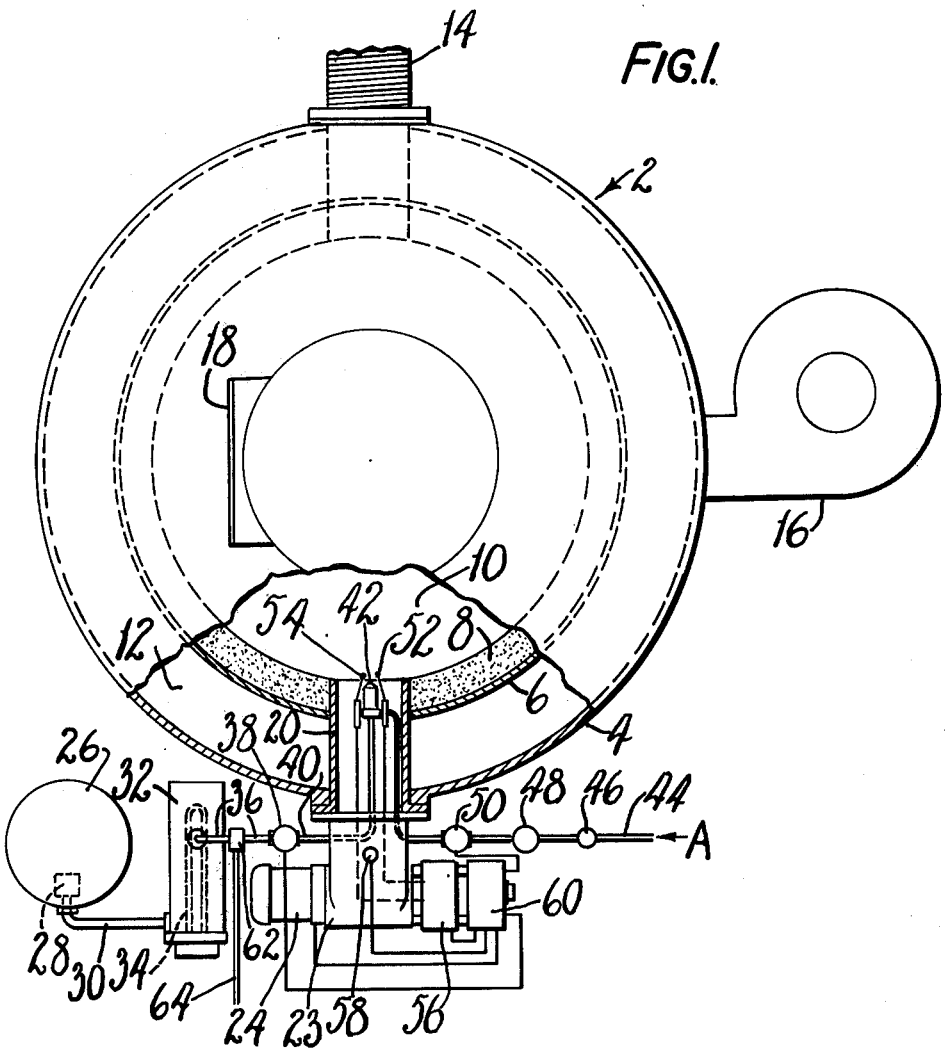
FIG. 1 is a plan view, partly in section, of a space heater incorporating the oil burner, various components being shown in section.

The space heater of FIG. 1 comprises a canister 2 having an outer wall 4 and an inner wall 6 which is lined with a refractory material at 8. The inner wall 6 defines a central cavity 10 and a passage 12 is formed between the walls 4, 6. A flue 14 leads from the cavity 10 and a fan 16 blows air into the passage 12, the air being emitted through an outlet 18 situated at the topmost part of the canister.

A hollow cylindrical conduit 20 passes through the passage 12 and is secured to the outer wall 4. A second fan not shown, is located in a fan housing 23, and is driven by a suitable electric motor 24. Combustion air is blown by the second fan through conduit 20 and into the cavity 10 and adjustment of suitable louvres in the fan housing 23 can be made to control the volume of air thus conveyed.

A waste oil storage tank 26 is located conveniently with respect to the heater unit and the oil passes through a filter 28 and pipe 30, to an oil pre-heating chamber 32 provided with a immersion heater 34. A pipe 36 passes from the reservoir 32 to solenoid valve 38 and a further pipe 40 passes thence through the fan housing 23 and the conduit 20 to the inner orifice of an atomizing jet nozzle 42 located centrally in the conduit.

Compressed air from a suitable source passes in the direction of arrow A through pipe 44 to a pressure switch 46 and a pressure reducing valve 48 to a solenoid valve 50, and from thence through the fan housing 23 and the conduit 20 to the outer orifice of the atomizing jet nozzle 42. The jet 42 is of a type well known and available to the trade and comprises an inner orifice through which the fuel may pass and an annular orifice which surround the inner orifice. Compressed air passing through the annular orifice draws fuel through the inner orifice and atomizes it as a fine mist.

Electrodes 52, 54 are located within the member 20 and are connected to a high voltage transformer 56 and provide a spark to ignite the atomized fuel, the mixture of the atomized fuel emitting from the jet nozzle 42 and the air from the second fan burning as a flame which enters the cavity 10.

A photo-electric cell 58 projects into the fan housing 23 and reacts to the light of the flame when the fuel and air mixture is burning. The arrangement is such that if the flame fails to ignite within a predetermined time from switching on the unit, the solenoid valves both close to cut off the supply of compressed air and fuel. Similarly, should the flame fail at any time, the electrodes will immediately provide a spark to re-ignite the fuel mixture, but if it should fail to ignite within the same predetermined time, then the supply of air and fuel will be cut off by closure of solenoid valves 38, 50. The jet nozzle can then be dismantled to examine it and clean away anything that may be causing a blockage in the inner orifice.

The standards demanded by the appropriate authorities regarding the automatic shut-down of such heaters under such conditions are strict and are intended to control possible pollution from unburnt fuel and the danger from re-igniting of any large amount of fuel which could be temporarily confined in the cavity 10.

If the supply of the spent sump oil terminates for any period, it is a simple matter to change over to the use of kerosene or other suitable fuel, and for this purpose a valve 62 is located in the line 36 and a pipe 64 connects the valve 61 to storage tank not shown, containing the alternative fuel.

Figure 4:
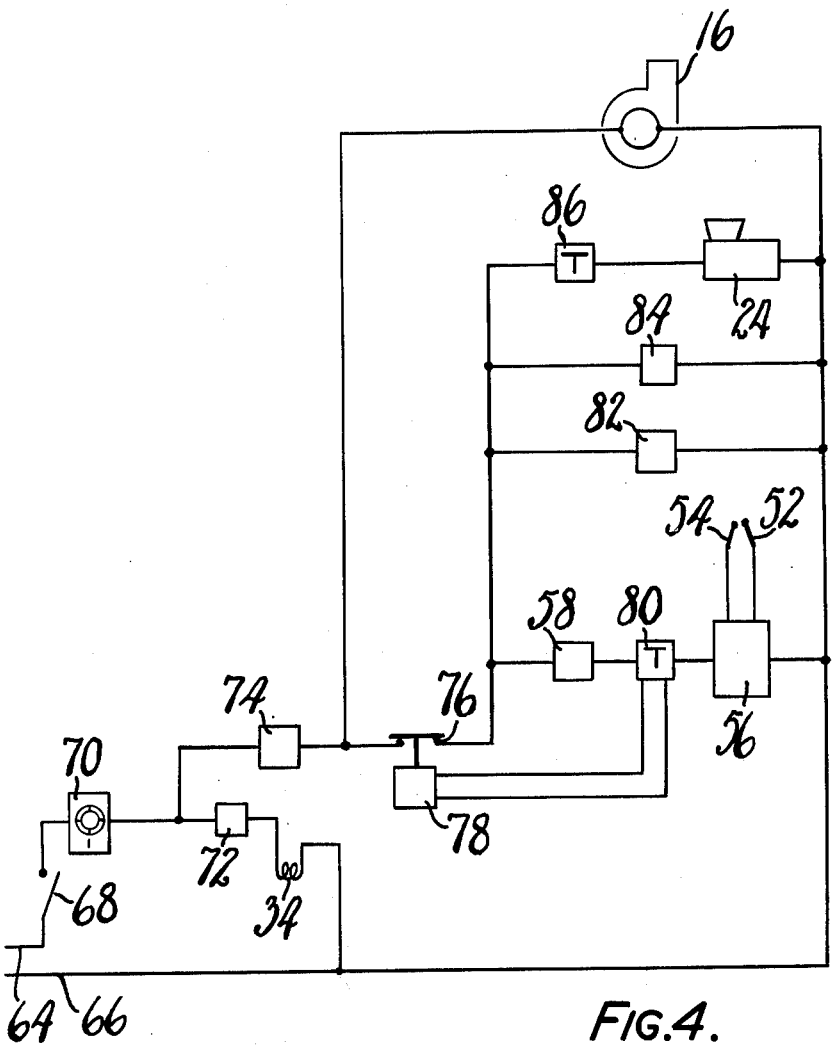

The burner is controlled by a control system contained in box 60 and illustrated in FIG. 4. As there shown a dc supply is applied to lines 64 and 66. The positive line 64 is connected to immersion heater 34, through a main switch 68, a time clock switch 70 and a thermostat switch 72, which is arranged to respond to the temperature of the oil in preheating chamber 32. Time clock switch 70 is also connected through an oil temperature switch 74 to, firstly, the fan 16 and secondly to the normally closed contact 76 of a cut out switch 78 within the control box 60. The contacts 76 are in turn connected in series with the photo-electric cell 58, a timer 80 and the transformer 56 for the electrodes 52, 54. Contacts 76 are also connected in parallel to the solenoid 82 of oil valve 38, the solenoid 84 of air valve 50, and to a delay circuit 86 which last is in series with the burner fan motor 24.

In operation, the storage tank 26 is filled with waste oil which is gravity fed through filter 28 and pipe 30 to the preheating chamber 32. Provided the main switch 68 and the time clock switch 70 are on, current is fed to immersion heater 34 which raises the temperature of the oil in chamber 32 to 140°–160° F. and maintaines that temperature under the control of thermostat switch 72.

When the oil in chamber 32 has reached the required temperature, oil temperature switch 74 closes and the solenoids 82 and 84 are energized to open the oil valve 38 and the air valve 50; simultaneously the fan 16 is started. The valves 38 and 50 connect the oil in chamber 32 and the compressed air supply to the jet nozzle 42, the pressure reducing valve 48 being adjusted to the pressure required for effective atomization of the fuel, that being approximately 20 psi for waste sump oil at the above temperature.

Provided that the cell 58 fails to see a flame, it completes a circuit to the transformer 56 and causes a high voltage current to pass across the gap between the electrodes 52, 54 as a spark which ignites the fine spray mist issuing from the atomizing jet nozzle 42. After a delay sufficient normally to allow for ignition, the delay circuit 86 operates to energize fan motor 24 and to cause secondary air to be supplied to the combustion chamber. The flame enters the cavity 10 and heats the wall 6. The air circulated in the passage by fan 16 is heated by contact with the hot wall 6 and the resulting heated air is delivered through outlet 18.

As soon as proper ignition is achieved, the cell 58 reacts to the flame and deenergizes the transformer 56. If the flame should subsequently go out, the cell reenergizes the transformer and automatically effects reignition. However, if the cell 58 continues to fail to detect ignition over a period of time determined by the timer 80, the latter operates solenoid 78 to open contacts 76 and thereby close the oil and air valves 38 and 50 and switch off fan motor 24.

The pressure reducing valve 48 is normally set at approximately 20 psi, and if the initial supply of compressed air is interrupted or reduced by any unforeseen circumstances, then the pressure switch 46, which is set at approximately 2 psi above that of the valve 48, will automatically close at least the solenoid valves 38, 50.

From the above it will be seen that with an arrangement as described it is possible to utilize waste, dirty oil as fuel for a space heater of this type, while still maintaining the requirements regarding safety and pollution factors. Furthermore it is a simple matter to change over from the use of waste oil to a more conventional but comparatively expensive fuel by operation of valve 62.

Figure 2:
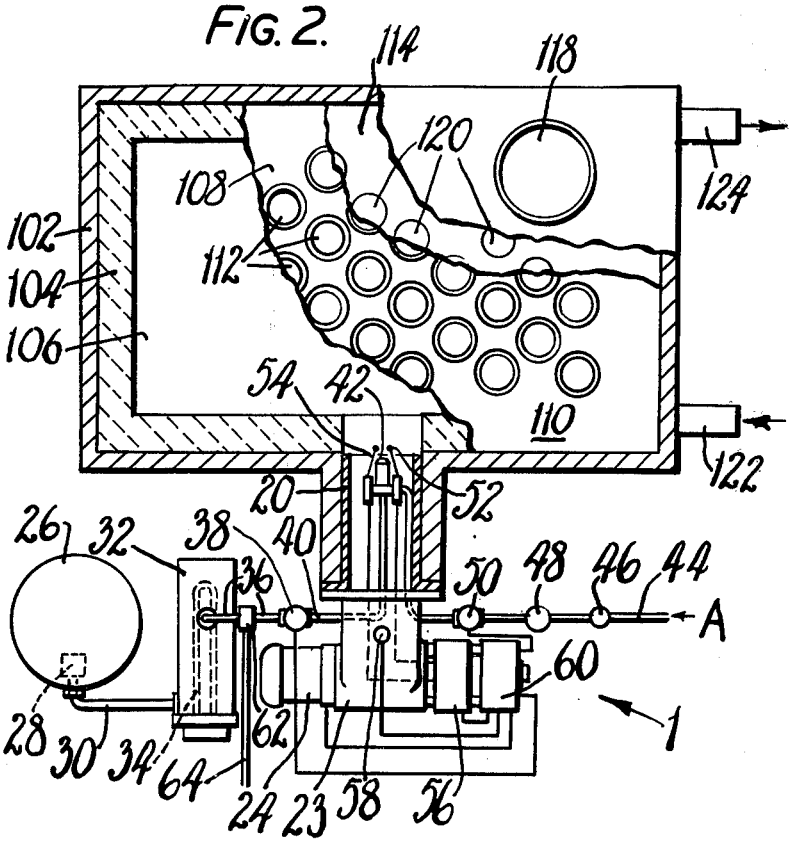
FIG. 2 is a plan view of a water heater incorporating the oil burner, some parts being broken away and in section.
Figure 3:
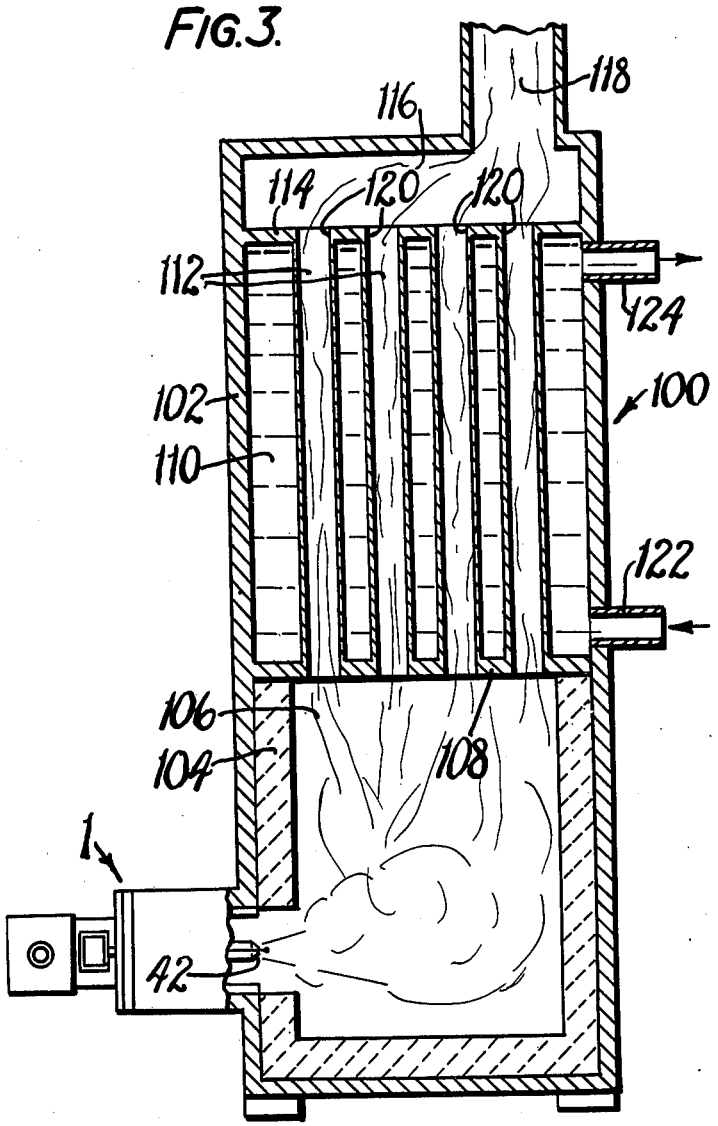
FIG. 3 is a vertical section view of the water heater of FIG. 2, and FIG. 4 schematically illustrates the circuit for controlling the burner.

Turning now to the water heater of FIGS. 2 and 3, that heater has an oil burner 1, which is identical to that shown in FIG. 1, and a boiler 100 in which the combustion gases are used to raise the water temperature; the parts of the oil burner are given the same reference numerals as those in FIG. 1 and no further description of it is necessary.

The boiler 100 which comprises an outer casing 102 has a lower portion lined with refractory material 104 to form a combustion chamber 106. A plate 108 separates the top of the combustion chamber from a water chamber 110 and boiler tubes 112 pass through the water chamber to align with holes 120 in a plate 114 at the top of the water chamber. A combustion fume collector box 116 is located above the water chamber and a flue 118 extends from the top of the collector box. Inlet and outlet water supply connections 122 and 124 respectively are provided in the wall of the water chamber.

The flame from the burner, which operates and is actuated as described above, is directed into the combustion chamber and the hot gases of combustion pass upwardly through the tubes 112, heating the water contained in the water chamber on their way; the gases then pass through holes 120 in the plate 144 and into the fume collector box 116, exhausting therefrom through the flue 118.

Obviously numerous modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the United States is:

1. An oil burner comprising:

(a) an oil/air jet nozzle having a central oil orifice and an outer air orifice, and having a conduit thereabout;

(b) a chamber for combustion oil;

(c) means for preheating oil in said chamber;

(d) an oil control valve;

(e) means connecting said chamber through said oil control valve to said central oil orifice;

(f) an air pressure responsive switch;

(g) an air control valve;

(h) means for supplying air under pressure through said air pressure responsive switch and said air control valve to said outer orifice, for atomizing oil through said central orifice;

(i) means for supplying combustion air through said conduit about said nozzle;

(j) a discontinuous electrically-operated ignition means adjacent said nozzle for providing an ignition spark when it is desired to initiate ignition;

(k) means for detecting the absence of ignition; and (l) control means operated by said detecting means and said pressure responsive switch for closing said oil control valve and air control valve on detection of loss of air pressure, for actuating said ignition means on detection of absence of ignition, and for closing said oil control valve and air control valves on failure of said ignition means to ignite the oil/air mixture from said nozzle.

2. An oil burner as claimed in claim 1, wherein said means connecting said chamber with said central orifice includes a further valve enabling said central orifice to be connected alternatively to a further supply of fuel.

3. A space heater comprising:

a hollow cannister having an outer wall and an inner wall spaced from said outer wall to form an inter-wall passage therebetween, a combustion chamber being defined within said inner wall;

an oil burner as defined in claim 1 with said conduit bridging said inter-wall passage and said nozzle direction towards said combustion chamber; and means for blowing space-heating air through said inter-wall passage; whereby said space-heating air is heated by contact with said inner wall.

4. A water heater comprising:

a water chamber;

a combustion chamber separated from but contiguous with said water chamber;

heat exchanger tubes communicating with said combustion chamber and passing through said water chamber; and an oil burner as defined in claim 1 with its said nozzle direction into said combustion chamber.

* * * * *